US012635808B2

(12) United States Patent
Mahoney et al.

(10) Patent No.: US 12,635,808 B2
(45) Date of Patent: May 26, 2026

(54) SYSTEM AND METHOD FOR IMPROVED PRESSURE ADJUSTMENT

(71) Applicant: Sleep Number Corporation, Minneapolis, MN (US)

(72) Inventors: Paul James Mahoney, Stillwater, MN (US); Matthew Glen Hilden, Robbinsdale, MN (US); Matthew Wayne Tilstra, Rogers, MN (US)

(73) Assignee: Sleep Number Corporation, Minneapolis, MN (US)

( * ) Notice: Subject to any disclaimer, the term of this patent is extended or adjusted under 35 U.S.C. 154(b) by 1270 days.

(21) Appl. No.: 17/078,558

(22) Filed: Oct. 23, 2020

(65) Prior Publication Data

US 2021/0244196 A1 Aug. 12, 2021

Related U.S. Application Data

(63) Continuation of application No. 15/662,623, filed on Jul. 28, 2017, now Pat. No. 10,813,470, which is a (Continued)

(51) Int. Cl.
*A47C 27/08* (2006.01)
*A47C 27/10* (2006.01)

(52) U.S. Cl.
CPC ..... *A47C 27/083* (2013.01); *A47C 27/082* (2013.01); *A47C 27/08* (2013.01); *A47C 27/10* (2013.01)

(58) Field of Classification Search
CPC ..... A47C 27/08; A47C 27/081; A47C 27/082; A47C 27/083; A47C 27/10; (Continued)

(56) References Cited

U.S. PATENT DOCUMENTS 4,644,597 A 2/1987 Walker
4,766,628 A 8/1988 Walker
(Continued)

FOREIGN PATENT DOCUMENTS

AU 2008/353971 11/2012
CA 2243942 C * 7/2007 ..... A47C 27/082
(Continued)

OTHER PUBLICATIONS

U.S. Appl. No. 09/471,592, Shafer, filed Dec. 23, 1999.
(Continued)

*Primary Examiner* — Robert G Santos
(74) *Attorney, Agent, or Firm* — Norton Rose Fulbright US LLP

(57) ABSTRACT

A method for adjusting pressure within an air bed comprises providing an air bed that includes an air chamber and a pump having a pump housing, selecting a desired pressure setpoint for the air chamber, calculating a pressure target, adjusting pressure within the air chamber until a pressure within the pump housing is substantially equal to the pressure target, determining an actual chamber pressure within the air chamber, and comparing the actual chamber pressure to the desired pressure setpoint to determine an adjustment factor error. The pressure target May be calculated based upon the desired pressure setpoint and a pressure adjustment factor. Furthermore, the pressure adjustment factor may be modified based upon the adjustment factor error determined by comparing the actual chamber pressure to the desired pressure setpoint.

15 Claims, 8 Drawing Sheets

Related U.S. Application Data continuation of application No. 14/283,675, filed on May 21, 2014, now Pat. No. 9,737,154, which is a continuation of application No. 12/936,084, filed as application No. PCT/US2008/059409 on Apr. 4, 2008, now Pat. No. 8,769,747.

(58) Field of Classification Search
CPC ..... A61G 7/05769; A61G 7/05776; Y10T 137/3584; Y10T 137/36; G05B 15/02
USPC ..... 5/706, 710, 713, 714, 644, 654, 655.3
See application file for complete search history.

(56) References Cited

U.S. PATENT DOCUMENTS 4,788,729 A 12/1988 Walker
D300,194 S 3/1989 Walker
4,829,616 A 5/1989 Walker
4,890,344 A 1/1990 Walker
4,897,890 A 2/1990 Walker
4,908,895 A 3/1990 Walker
D313,973 S 1/1991 Walker
4,991,244 A 2/1991 Walker
5,023,967 A 6/1991 Ferrand
5,138,729 A 8/1992 Ferrand
5,144,706 A 9/1992 Walker et al.
5,170,522 A 12/1992 Walker
5,277,187 A 1/1994 Pillsbury
5,345,629 A 9/1994 Ferrand
D368,475 S 4/1996 Scott
5,509,154 A 4/1996 Shafer et al.
5,564,140 A 10/1996 Shoenhair et al.
5,629,873 A 5/1997 Mittal et al.
5,642,546 A 7/1997 Shoenhair
5,652,484 A 7/1997 Shafer et al.
5,735,267 A 4/1998 Tobia
5,765,246 A 6/1998 Shoenhair
5,903,941 A 5/1999 Shafer et al.
5,904,172 A 5/1999 Gifft et al.
6,014,784 A 1/2000 Taylor et al.
6,037,723 A 3/2000 Shafer et al.
6,088,642 A 7/2000 Finkelstein et al.
6,088,643 A 7/2000 Long et al.
6,098,000 A 8/2000 Long et al.
6,108,844 A 8/2000 Kraft et al.
6,161,231 A 12/2000 Kraft et al.
6,202,239 B1 3/2001 Ward et al.
6,397,419 B1 6/2002 Mechache
6,483,264 B1 11/2002 Shafer et al.
6,686,711 B2 2/2004 Rose et al.
6,708,357 B2 3/2004 Gaboury et al.
6,763,541 B2 7/2004 Mahoney et al.
6,789,284 B2 9/2004 Kamp
6,804,848 B1 10/2004 Rose
6,832,397 B2 12/2004 Gaboury et al.
D502,929 S 3/2005 Copeland et al.
6,883,191 B2 4/2005 Gaboury et al.
7,022,113 B2 4/2006 Lockwood et al.
7,389,554 B1 6/2008 Rose
7,865,988 B2 1/2011 Koughan et al.
8,162,009 B2 * 4/2012 Chaffee ..... A47C 31/008 141/10
8,282,452 B2 10/2012 Grigsby et al.
8,336,369 B2 12/2012 Mahoney
8,413,278 B2 * 4/2013 Chaffee ..... A47C 27/083 5/713
8,444,558 B2 5/2013 Young et al.
D691,118 S 10/2013 Ingham et al.
D697,874 S 1/2014 Stusynski et al.
D698,338 S 1/2014 Ingham
D701,536 S 3/2014 Shakal et al.
8,672,853 B2 3/2014 Young
8,745,788 B2 6/2014 Bhai
8,769,747 B2 7/2014 Mahoney et al.
8,839,474 B2 * 9/2014 Chaffee ..... A47C 27/082 141/10
8,893,339 B2 11/2014 Fleury et al.
8,931,329 B2 1/2015 Mahoney et al.
8,966,689 B2 3/2015 McGuire et al.
8,973,183 B1 3/2015 Palashewski et al.
8,984,687 B2 3/2015 Stusynski et al.
D728,254 S 5/2015 Blazar et al.
D737,250 S 8/2015 Ingham et al.
9,131,781 B2 9/2015 Zaiss et al.
9,289,073 B2 * 3/2016 Chaffee ..... G05D 16/208
9,314,118 B2 4/2016 Wahrmund et al.
9,370,457 B2 6/2016 Nunn et al.
9,392,879 B2 7/2016 Nunn et al.
9,510,688 B2 12/2016 Nunn et al.
9,578,941 B2 2/2017 Blazar et al.
9,635,953 B2 5/2017 Nunn et al.
9,730,524 B2 8/2017 Chen et al.
9,737,154 B2 8/2017 Mahoney et al.
9,770,114 B2 9/2017 Brosnan et al.
9,844,275 B2 12/2017 Nunn et al.
D809,843 S 2/2018 Keeley et al.
D812,393 S 3/2018 Karschnik et al.
9,924,813 B1 3/2018 Basten et al.
10,045,897 B2 8/2018 Streeter et al.
10,092,242 B2 10/2018 Nunn et al.
10,143,312 B2 12/2018 Brosnan et al.
10,149,549 B2 12/2018 Erko et al.
10,182,661 B2 1/2019 Nunn et al.
D840,732 S 2/2019 Peterson et al.
10,194,753 B2 2/2019 Fleury et al.
10,201,234 B2 2/2019 Nunn et al.
10,251,490 B2 4/2019 Nunn et al.
10,285,508 B2 5/2019 Rose et al.
10,342,358 B1 7/2019 Palashewski et al.
D857,433 S 8/2019 Negus et al.
10,434,022 B2 10/2019 Streeter et al.
10,441,086 B2 10/2019 Nunn et al.
10,512,575 B2 12/2019 Streeter et al.
10,531,745 B2 1/2020 Chen et al.
10,539,170 B2 1/2020 Peterson et al.
10,575,654 B2 3/2020 Shakal
10,646,050 B2 5/2020 Nunn et al.
10,674,832 B2 6/2020 Brosnan et al.
10,677,232 B2 6/2020 Shakal et al.
10,716,512 B2 7/2020 Nunn et al.
10,729,253 B1 8/2020 Gaunt
10,729,255 B2 8/2020 Erko et al.
10,736,432 B2 8/2020 Nunn et al.
10,765,224 B2 9/2020 Chen et al.
10,772,438 B2 9/2020 Griffith et al.
10,813,470 B2 10/2020 Mahoney et al.
10,827,846 B2 11/2020 Karschnik et al.
10,888,173 B2 1/2021 Shakal
10,980,351 B2 * 4/2021 Nunn ..... A47C 31/008
10,993,546 B2 5/2021 Shakal et al.
11,001,447 B2 5/2021 Shutes et al.
2002/0184711 A1 12/2002 Mahoney et al.
2003/0182728 A1 10/2003 Chapman et al.
2004/0186630 A1 9/2004 Shier et al.
2007/0000559 A1 1/2007 Ebel
2007/0227594 A1 10/2007 Chaffe
2008/0077020 A1 3/2008 Young et al.
2008/0189865 A1 8/2008 Bhai
2008/0307582 A1 12/2008 Flocard et al.
2009/0314354 A1 12/2009 Chaffee
2010/0174198 A1 7/2010 Young et al.
2010/0206051 A1 8/2010 Mahoney
2011/0138539 A1 6/2011 Mahoney et al.
2011/0144455 A1 6/2011 Young et al.
2011/0306844 A1 12/2011 Young
2012/0204970 A1 * 8/2012 Chaffee ..... A47C 27/082 137/224
2012/0311790 A1 12/2012 Nomura et al.
2013/0284274 A1 * 10/2013 Chaffee ..... A47C 27/083 137/224
2014/0007656 A1 1/2014 Mahoney
2014/0137332 A1 5/2014 McGuire et al.
2014/0182061 A1 7/2014 Zaiss

(56) References Cited

U.S. PATENT DOCUMENTS

| | | | |
|---|---|---|---|
| 2014/0250597 | A1 | 9/2014 | Chen et al. |
| 2014/0257571 | A1 | 9/2014 | Chen et al. |
| 2014/0259417 | A1 | 9/2014 | Nunn et al. |
| 2014/0259418 | A1 | 9/2014 | Nunn et al. |
| 2014/0259419 | A1 | 9/2014 | Stusynski |
| 2014/0259431 | A1 | 9/2014 | Fleury et al. |
| 2014/0259433 | A1 | 9/2014 | Nunn et al. |
| 2014/0259434 | A1 | 9/2014 | Nunn et al. |
| 2014/0277611 | A1 | 9/2014 | Nunn et al. |
| 2014/0277778 | A1 | 9/2014 | Nunn et al. |
| 2014/0277822 | A1 | 9/2014 | Nunn et al. |
| 2015/0007393 | A1 | 1/2015 | Palashewski |
| 2015/0025327 | A1 | 1/2015 | Young et al. |
| 2015/0026896 | A1 | 1/2015 | Fleury et al. |
| 2015/0157137 | A1 | 6/2015 | Nunn et al. |
| 2015/0157519 | A1 | 6/2015 | Stusynski et al. |
| 2015/0182033 | A1 | 7/2015 | Brosnan et al. |
| 2015/0182397 | A1 | 7/2015 | Palashewski et al. |
| 2015/0182399 | A1 | 7/2015 | Palashewski et al. |
| 2015/0182418 | A1 | 7/2015 | Zaiss |
| 2015/0290059 | A1 | 10/2015 | Brosnan et al. |
| 2015/0366366 | A1 | 12/2015 | Zaiss et al. |
| 2015/0374137 | A1 | 12/2015 | Mahoney et al. |
| 2016/0022520 | A1 | 1/2016 | Streeter et al. |
| 2016/0100696 | A1 | 4/2016 | Palashewski et al. |
| 2016/0184155 | A1 | 6/2016 | Streeter et al. |
| 2016/0192886 | A1 | 7/2016 | Nunn et al. |
| 2016/0242562 | A1 | 8/2016 | Karschnik et al. |
| 2016/0338871 | A1 | 11/2016 | Nunn et al. |
| 2016/0367039 | A1 | 12/2016 | Young et al. |
| 2017/0003666 | A1 | 1/2017 | Nunn et al. |
| 2017/0035212 | A1 | 2/2017 | Nunn et al. |
| 2017/0049243 | A1 | 2/2017 | Nunn et al. |
| 2017/0196369 | A1 | 7/2017 | Nunn et al. |
| 2017/0303697 | A1 | 10/2017 | Chen et al. |
| 2017/0318980 | A1 | 11/2017 | Mahoney et al. |
| 2018/0116418 | A1 | 5/2018 | Shakal et al. |
| 2018/0116419 | A1 | 5/2018 | Shakal |
| 2018/0125259 | A1 | 5/2018 | Peterson et al. |
| 2018/0125260 | A1 | 5/2018 | Peterson et al. |
| 2019/0000701 | A1 | 1/2019 | Streeter et al. |
| 2019/0021513 | A1 | 1/2019 | Nunn et al. |
| 2019/0082855 | A1 | 3/2019 | Brosnan et al. |
| 2019/0104858 | A1 | 4/2019 | Erko et al. |
| 2019/0125095 | A1 | 5/2019 | Nunn et al. |
| 2019/0125097 | A1 | 5/2019 | Nunn et al. |
| 2019/0200777 | A1 | 7/2019 | Demirli et al. |
| 2019/0201265 | A1 | 7/2019 | Sayadi et al. |
| 2019/0201266 | A1 | 7/2019 | Sayadi et al. |
| 2019/0201267 | A1 | 7/2019 | Demirli et al. |
| 2019/0201268 | A1 | 7/2019 | Sayadi et al. |
| 2019/0201269 | A1 | 7/2019 | Sayadi et al. |
| 2019/0201270 | A1 | 7/2019 | Sayadi et al. |
| 2019/0201271 | A1 | 7/2019 | Grey et al. |
| 2019/0206416 | A1 | 7/2019 | Demirli et al. |
| 2019/0209405 | A1 | 7/2019 | Sayadi et al. |
| 2019/0231084 | A1 | 8/2019 | Nunn et al. |
| 2019/0254438 | A1 | 8/2019 | Rose et al. |
| 2019/0279745 | A1 | 9/2019 | Sayadi et al. |
| 2019/0328147 | A1 | 10/2019 | Palashewski |
| 2020/0187667 | A1 | 6/2020 | Shakal |
| 2020/0221883 | A1 | 7/2020 | Chen et al. |
| 2020/0256367 | A1 | 8/2020 | Griffith et al. |
| 2020/0359805 | A1 | 11/2020 | Brosnan et al. |
| 2020/0375369 | A1 | 12/2020 | Negus et al. |
| 2020/0400135 | A1 | 12/2020 | Shakal et al. |
| 2021/0037986 | A1 | 2/2021 | Gaunt |
| 2021/0145183 | A1 | 5/2021 | Negus et al. |
| 2021/0145185 | A1 | 5/2021 | Negus et al. |
| 2021/0244196 | A1* | 8/2021 | Mahoney ..... A47C 27/083 |

FOREIGN PATENT DOCUMENTS

| | | |
|---|---|---|
| CA | 2720467 | 12/2013 |
| WO | WO 00/03628 | 1/2000 |
| WO | WO 2007/016054 | 2/2007 |
| WO | WO 2009/123641 | 10/2009 |

OTHER PUBLICATIONS

U.S. Appl. No. 14/594,843, Rose et al., filed Jan. 12, 2015.
U.S. Appl. No. 17/006,388, McGuire et al., filed Aug. 28, 2020.
U.S. Appl. No. 17/145,645, Shakal, filed Jan. 11, 2021.
U.S. Appl. No. 17/224,936, Shakal et al., filed Apr. 7, 2021.
U.S. Appl. No. 29/583,852, Keeley, Nov. 9, 2016.
U.S. Appl. No. 29/719,090, Kirk et al., filed Dec. 31, 2019.
*American National Manufacturing Inc.* v. *Select Comfort Corporation*, "American National Manufacturing Inc.'s Petition for Inter Partes Review," Case IPR2019-00497, U.S. Pat. No. 8,769,747, 68 pages.
*American National Manufacturing Inc.* v. *Select Comfort Corporation*"American National Manufacturing Inc.'s Petition for Inter Partes Review," Case IPR2019-00500, U.S. Pat. No. 9,737,154, 73 pages.
U.S. Appl. No. 12/936,084, Advisory Action mailed Oct. 18, 2013, 3 pages.
U.S. Appl. No. 12/936,084, Examiner Interview Summary mailed Aug. 6, 2013, 3 pages.
U.S. Appl. No. 12/936,084, Final Office Action mailed Jan. 10, 2013, 16 pages.
U.S. Appl. No. 12/936,084, Final Office Action mailed Jul. 29, 2013, 15 pages.
U.S. Appl. No. 12/936,084, Non Final Office Action mailed Aug. 2, 2012, 13 pages.
U.S. Appl. No. 12/936,084, Notice of Allowance mailed Mar. 12, 2014, 8 pages.
U.S. Appl. No. 12/936,084, Response filed Jan. 29, 2014 to Advisory Action mailed Oct. 18, 2013, 16 pages.
U.S. Appl. No. 12/936,084, Response filed May 10, 2013 to Non Final Office Action mailed Jan. 10, 2013, 13 pages.
U.S. Appl. No. 12/936,084, Response filed Nov. 8, 2012 to Non Final Office Action mailed Aug. 2, 2013, 13 pages.
U.S. Appl. No. 12/936,084, Response filed Sep. 27, 2013 to Non Final Office Action mailed Jul. 29, 2013, 14 pages.
Australian Application Serial No. 2008353972, First Examiner Report dated Apr. 18, 2011, 2 pages.
Australian Application Serial No. 2008353972, First Examiner Report dated Jul. 18, 2011, 2 pages.
Australian Application Serial No. 2008353972, Response filed Jul. 3, 2012 to Examiner Report mailed Jul. 18, 2011, 17 pages.
Canadian Application Serial No. 2,720,467, Office Action mailed May 31, 2012, 2 pages.
Canadian Application Serial No. 2,720,467, Response filed Nov. 29, 2012 to Office Action mailed May 31, 2012, 10 pages.
Declaration of Dr. William Messner in Support of Patent Owner's Preliminary Response dated Apr. 25, 2019, 103 pages.
Declaration of Joshua W. Phinney dated Dec. 21, 2018, 93 pages.
Declaration of Kyle L. Elliott in Support of Petitioner's Amended Opposition to Patent Owner's Motion for Additional Discovery and Other Miscellaneous Relief, dated Oct. 3, 2019, 6 pages.
Declaration of Kyle L. Elliott in Support of Petitioner's Reply to Patent Owner's Request to Rescind the Filing Date of the Petition and Deny Institution of the Petition for Failure to Timely Serve the Petition Upon Patent Owner dated May 9, 2019, 5 pages.
European Application Serial No. 08745110.0, Office Action mailed Nov. 22, 2010, 2 pages.
European Application Serial No. 08745110.0, Response filed Dec. 23, 2010 to Office Action mailed Nov. 22, 2010,4 pages.
European Application Serial No. 08745110.0, Supplementary European Search Report mailed Jan. 25, 2012, 5 pages.
File History for U.S. Pat. No. 8,769,747, 383 pages.
File History for U.S. Pat. No. 9,737,154, 350 pages.
First Amended Complaint for Patent Infringement dated Mar. 23, 2018, 24 pages.

(56) References Cited

OTHER PUBLICATIONS

Institution of Inter Partes Review in Case No. IPR2019-00497, dated Jul. 24, 2019, 43 pages.
Institution of Inter Partes Review in Case No. IPR2019-00500, dated Jul. 24, 2019, 43 pages.
Patent Owner's Preliminary Response, Case No. IPR2019-00497, dated Apr. 25, 2019, 77 pages.
Patent Owner's Preliminary Response, Case No. IPR2019-00500, dated Apr. 25, 2019, 76 pages.
PCT International Search Report in International Appln. No. PCT/US08/59409, dated Aug. 15, 2008, 2 pages.
PCT International Written Opinion in International Appln. No. PCT/US08/59409, dated Aug. 15, 2008, 5 pages.
Petitioner's Reply to Patent Owner's Request to Rescind the Filing Date of the Petition and Deny Institution of the Petition for Failure to Timely Serve the Petition Upon Patent Owner in Case No. IPR2019-00497, dated May 9, 2019, 15 pages.
Petitioner's Reply to Patent Owner's Request to Rescind the Filing Date of the Petition and Deny Institution of the Petition for Failure to Timely Serve the Petition Upon Patent Owner in Case No. IPR2019-00500, dated May 9, 2019, 15 pages.
Random House Webster's Unabridged Dictionary Excerpt, Second Edition, Oct. 1999, 5 pages.
*Sleep Number* v. *ANM (TX)* Complaint for Patent Infringement dated Dec. 29, 2017, 16 pages.
*Sleep Number* v. *Sizewise (TX)* Complaint for Patent Infringement dated Dec. 29, 2017, 16 pages.
U.S. Pat. No. 8,769,747 Claim Listing, 4 pages.
U.S. Pat. No. 9,737,154 Claim Listing, 6 pages.
Webster's II New Riverside University Dictionary Excerpt, The Riverside Publishing Company, 5 pages.
International Preliminary Report on Patentability in International Appln. No. PCT/US2008/059409, mailed Oct. 5, 2010, 6 pages.

* cited by examiner

SYSTEM AND METHOD FOR IMPROVED PRESSURE ADJUSTMENT

BACKGROUND OF THE INVENTION

The present invention relates to a system and method for adjusting the pressure in an inflatable object. More particularly, the present invention relates to a system and method for adjusting the pressure in an air bed in less time and with greater accuracy.

Advances made in the quality of air beds having air chambers as support bases have resulted in vastly increased popularity and sales of such air beds. These air beds are advantageous in that they have an electronic control panel which allows a user to select a desired inflation setting for optimal comfort and to change the inflation setting at any time, thereby providing changes in the firmness of the bed.

Air bed systems, such as the one described in U.S. Pat. No. 5,904,172 which is incorporated herein by reference in its entirety, generally allow a user to select a desired pressure for each air chamber within the mattress. Upon selecting the desired pressure, a signal is sent to a pump and valve assembly in order to inflate or deflate the air bladders as necessary in order to achieve approximately the desired pressure within the air bladders.

In one embodiment of an air bed system, there are two separate air hoses coupled to each of the air bladders. A first air hose extends between the interior of the air bladder and the valve assembly associated with the pump. This first air hose fluidly couples the pump to the air bladder, and is structured to allow air to be added or removed from the air bladder. A second hose extends from the air bladder to a pressure transducer, which continuously monitors the pressure within the air bladder. Thus, as air is being added or removed from the air bladder, the pressure transducer coupled to the second hose is able to continuously check the actual air bladder pressure, which may then be compared to the desired air pressure in order to determine when the desired air pressure within the bladder has been reached.

In another embodiment of an air bed system, there is only a single hose coupled to each of the air bladders. In particular, the hose extends between the interior of the air bladder and the valve assembly associated with the pump, and is structured to allow air to be added or removed from the air bladder. Instead of having a second hose with a pressure transducer coupled thereto for continuously reading the pressure within the air bladder, a pressure transducer is positioned within a chamber of the valve assembly. Once the user selects the desired air pressure within the air bladder, the pressure transducer first senses a pressure in the chamber, which it equates to an actual pressure in the air bladder. Then, air is added or removed from the bladder as necessary based upon feedback from the sensed pressure. After a first iteration of sensing the pressure and adding or removing air, the pump turns off and the pressure within the chamber is once again sensed by the pressure transducer and compared to the desired air pressure. The process of adding or removing air, turning off the pump, and sensing pressure within the chamber is repeated for several more iterations until the pressure sensed within the chamber is within an acceptable range close to the desired pressure. As one skilled in the art will appreciate, numerous iterations of inflating and deflating the air bladder may be required until the sensed chamber pressure falls within the acceptable range of the desired pressure.

Thus, while this second embodiment of an air bed system may be desired because it minimizes the necessary number of hoses, it is rather inefficient in that numerous iterations may be required before the sensed pressure reaches the desired pressure. Furthermore, the pump must be turned off each time the pressure transducer takes a pressure measurement, which increases the amount of time that the user must wait until the air bladder reaches the desired pressure.

Therefore, there is a need for an improved pressure adjustment system and method for an air bed that is able to minimize the amount of time and the number of adjustment iterations necessary to achieve a desired pressure in an air bladder, while also increasing the accuracy of the actual bladder pressure.

BRIEF SUMMARY OF THE INVENTION

The present invention solves the foregoing problems by providing a method for adjusting pressure within an air bed comprising providing an air bed that includes an air chamber and a pump having a pump housing, selecting a desired pressure setpoint for the air chamber, calculating a pressure target, adjusting pressure within the air chamber until a pressure within the pump housing is substantially equal to the pressure target, determining an actual chamber pressure within the air chamber, and comparing the actual chamber pressure to the desired pressure setpoint to determine an adjustment factor error. The pressure target may be calculated based upon the desired pressure setpoint and a pressure adjustment factor. Furthermore, the pressure adjustment factor may be modified based upon the adjustment factor error determined by comparing the actual chamber pressure to the desired pressure setpoint.

The present invention also provides a pressure adjustment system for an air bed comprising an air chamber, a pump in fluid communication with the air chamber and including a pump manifold and at least one valve, an input device adapted to receive a desired pressure setpoint selected by a user, a pressure sensing means adapted to monitor pressure within the pump manifold, and a control device operably connected to the input device and to the pressure sensing means. The control device includes control logic that is capable of calculating a manifold pressure target based upon the desired pressure setpoint and a pressure adjustment factor, monitoring pressure within the pump manifold, adjusting pressure within the air chamber until the sensed manifold pressure is within an acceptable pressure target error range of the manifold pressure target, comparing an actual chamber pressure to the desired pressure setpoint to quantify an adjustment factor error, and calculating an updated pressure adjustment factor based upon the adjustment factor error.

DETAILED DESCRIPTION OF THE INVENTION

Figure 1:
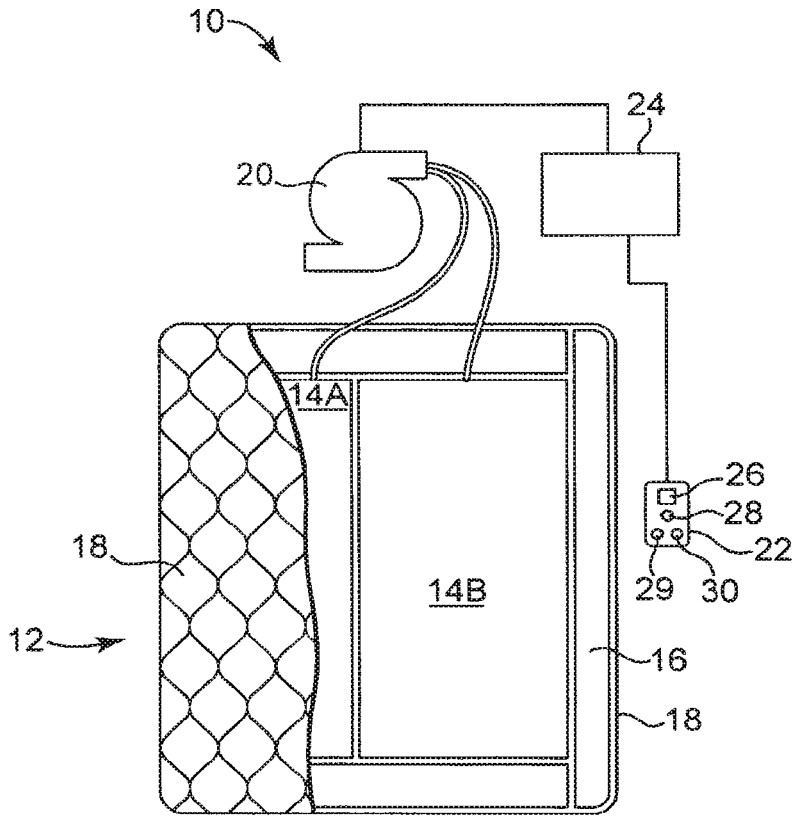
FIG. 1 is a diagrammatic representation of one embodiment of an air bed system.

Referring now to the figures, and first to FIG. 1, there is shown a diagrammatic representation of air bed system 10 of the present invention. The system 10 includes bed 12, which generally comprises at least one air chamber 14 surrounded by a resilient, preferably foam, border 16 and encapsulated by bed ticking 18.

As illustrated in FIG. 1, bed 12 is a two chamber design having a first air chamber 14A and a second air chamber 14B. Chambers 14A and 14B are in fluid communication with pump 20. Pump 20 is in electrical communication with a manual, hand-held remote control 22 via control box 24. Remote control 22 may be either "wired" or "wireless." Control box 24 operates pump 20 to cause increases and decreases in the fluid pressure of chambers 14A and 14B based upon commands input by a user through remote control 22. Remote control 22 includes display 26, output selecting means 28, pressure increase button 29, and pressure decrease button 30. Output selecting means 28 allows the user to switch the pump output between first and second chambers 14A and 14B, thus enabling control of multiple chambers with a single remote control unit. Alternatively, separate remote control units may be provided for each chamber. Pressure increase and decrease buttons 29 and 30 allow a user to increase or decrease the pressure, respectively, in the chamber selected with output selecting means 28. As those skilled in the art will appreciate, adjusting the pressure within the selected chamber causes a corresponding adjustment to the firmness of the chamber.

Figure 2:
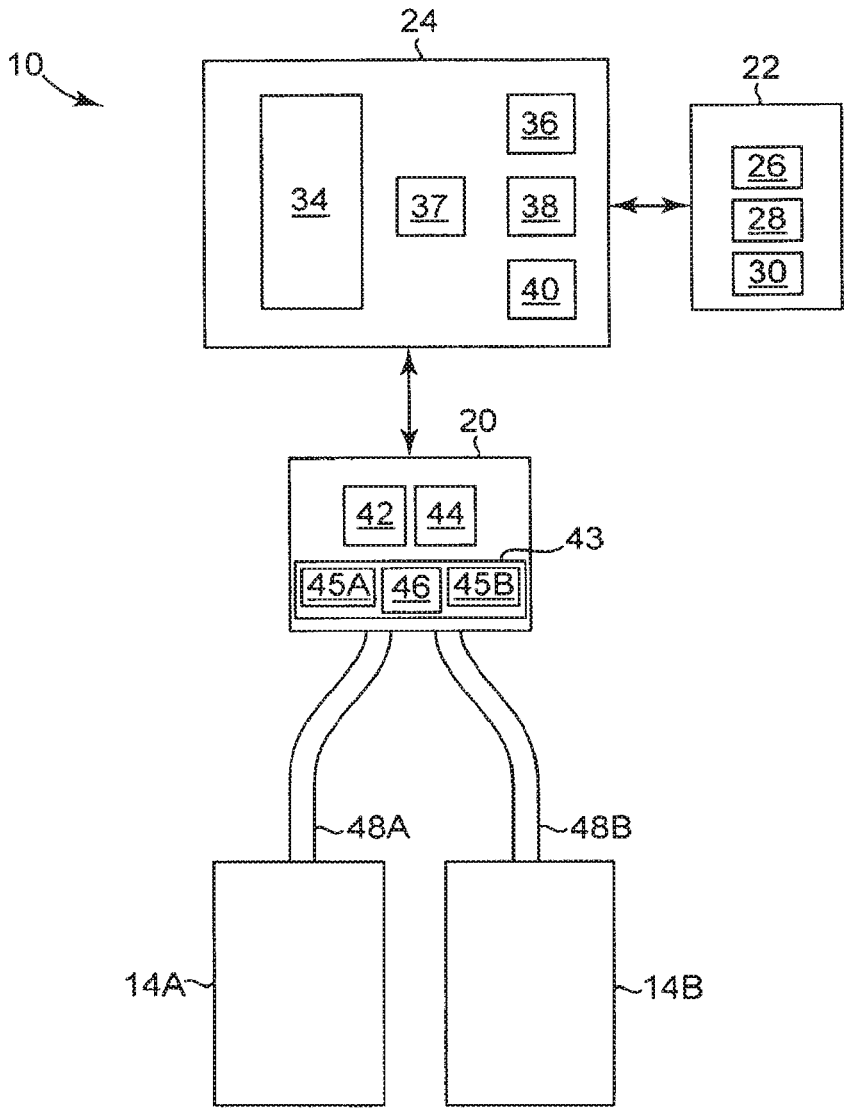
FIG. 2 is a block diagram of the various components of the air bed system illustrated in FIG. 1.

FIG. 2 shows a block diagram detailing the data communication between the various components of system 10. Beginning with control box 24, it can be seen that control box 24 comprises power supply 34, at least one microprocessor 36, memory 37, at least one switching means 38, and at least one analog to digital (A/D) converter 40. Switching means 38 may be, for example, a relay or a solid state switch.

Pump 20 is preferably in two-way communication with control box 24. Also in two-way communication with control box 24 is hand-held remote control 22. Pump 20 includes motor 42, pump manifold 43, relief valve 44, first control valve 45A, second control valve 45B, and pressure transducer 46, and is fluidly connected with left chamber 14A and right chamber 14B via first tube 48A and second tube 48B, respectively. First and second control valves 45A and 45B are controllable by switching means 38, and are structured to regulate the flow of fluid between pump 20 and first and second chambers 14A and 14B, respectively.

Figure 5:
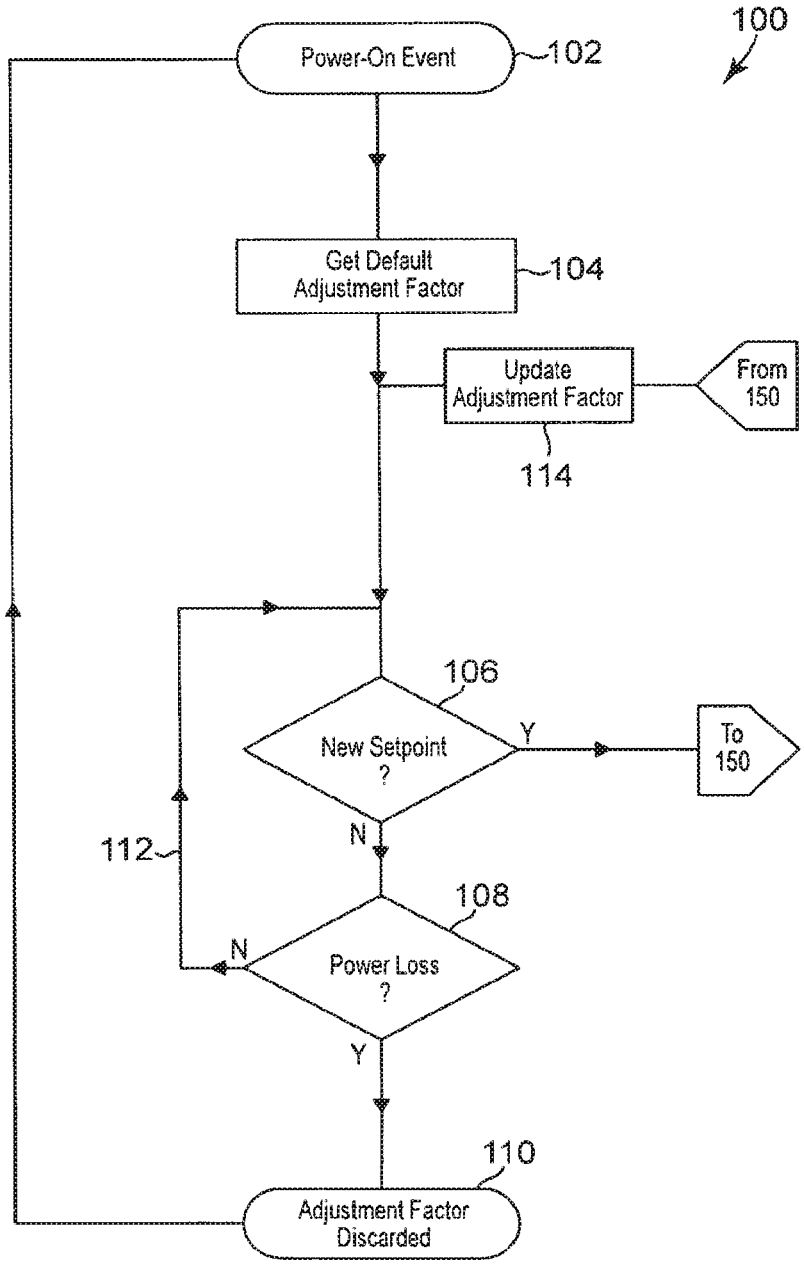
FIG. 5 is a flowchart illustrating one embodiment of a pressure setpoint monitoring method in accordance with the present invention.
Figure 6:
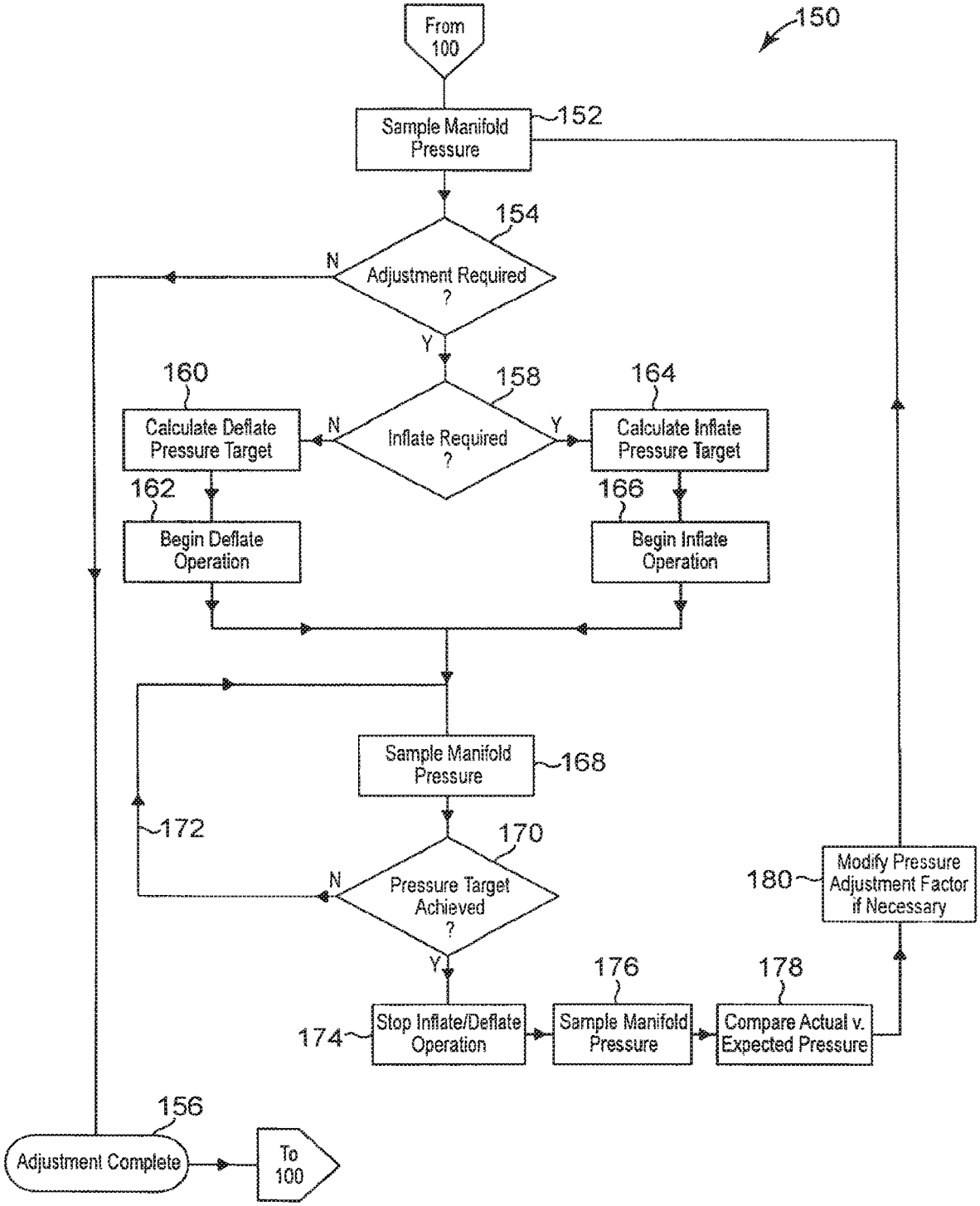
FIG. 6 is a flowchart illustrating one embodiment of an improved pressure adjustment method in accordance with the present invention.
Figure 7:
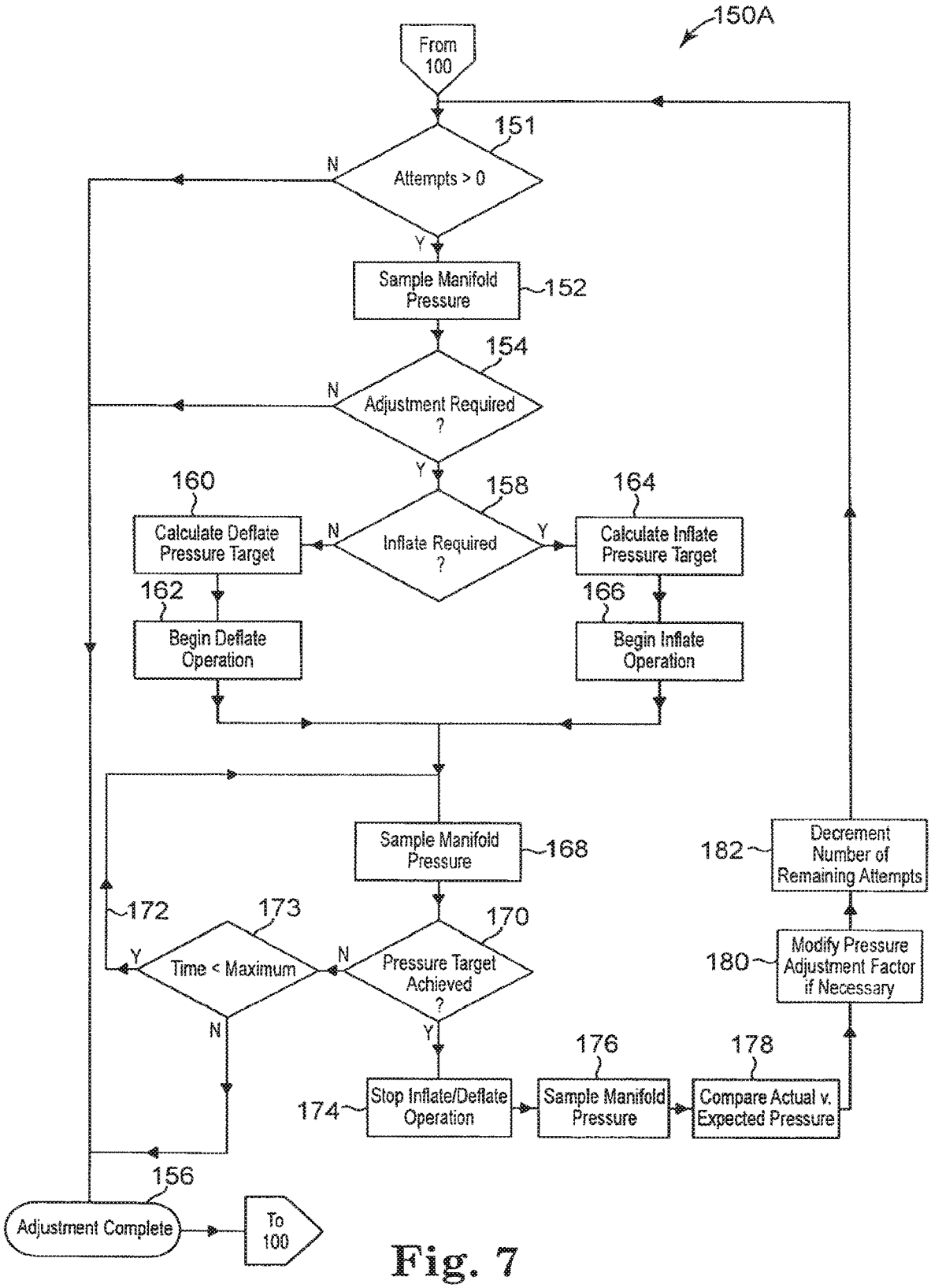
FIG. 7 is a flowchart illustrating a second embodiment of an improved pressure adjustment method in accordance with the present invention.

In operation, power supply 34 receives power, preferably 110 VAC power, from an external source and converts it to the various forms required by the different components. Microprocessor 36 is used to control various logic sequences of the present invention. Examples of such sequences are illustrated in FIGS. 5-7, which will be discussed in detail below.

The embodiment of system 10 shown in FIG. 2 contemplates two chambers 14A and 14B and a single pump 20. Alternatively, in the case of a bed with two chambers, it is envisioned that a second pump may be incorporated into the system such that a separate pump is associated with each chamber. Separate pumps would allow each chamber to be inflated or deflated independently and simultaneously. Additionally, a second pressure transducer may also be incorporated into the system such that a separate pressure transducer is associated with each chamber.

In the event that microprocessor 36 sends a decrease pressure command to one of the chambers, switching means 38 is used to convert the low voltage command signals sent by microprocessor 36 to higher operating voltages sufficient to operate relief valve 44 of pump 20. Alternatively, switching means 38 could be located within pump 20. Opening relief valve 44 allows air to escape from first and second chambers 14A and 14B through air tubes 48A and 48B. During deflation, pressure transducer 46 sends pressure readings to microprocessor 36 via A/D converter 40. A/D converter 40 receives analog information from pressure transducer 46 and converts that information to digital information useable by microprocessor 36.

In the event that microprocessor 36 sends an increase pressure command, pump motor 42 may be energized, sending air to the designated chamber through air tube 48A or 48B via the corresponding valve 45A or 45B. While air is being delivered to the designated chamber in order to increase the firmness of the chamber, pressure transducer 46 senses pressure within pump manifold 43. Again, pressure transducer 46 sends pressure readings to microprocessor 36 via A/D converter 40. Microprocessor 36 uses the information received from A/D converter 40 to determine the difference between the actual pressure in the chamber 14 and the desired pressure. Microprocessor 36 sends the digital signal to remote control 22 to update display 26 on the remote control in order to convey the pressure information to the user.

Generally speaking, during an inflation or deflation process, the pressure sensed within pump manifold 43 provides an approximation of the pressure within the chamber. However, when it is necessary to obtain an accurate approximation of the chamber pressure, other methods must be used.

One method of obtaining a pump manifold pressure reading that is substantially equivalent to the actual pressure within a chamber is to turn off the pump, allow the pressure within the chamber and the pump manifold to equalize, and then sense the pressure within the pump manifold with a pressure transducer. Thus, providing a sufficient amount of time to allow the pressures within the pump manifold 43 and the chamber to equalize may result in pressure readings that are accurate approximations of the actual pressure within the chamber. One obvious drawback to this type of method is the need to turn off the pump prior to obtaining the pump manifold pressure reading.

A second method of obtaining a pump manifold pressure reading that is substantially equivalent to the actual pressure within a chamber is through use of the pressure adjustment method in accordance with the present invention. The pressure adjustment method is described in detail in FIGS. 5-7. However, in general, the method functions by approximating the chamber pressure based upon a mathematical relationship between the chamber pressure and the pressure measured within the pump manifold (during both an inflation cycle and a deflation cycle), thereby eliminating the need to turn off the pump in order to obtain a substantially accurate approximation of the chamber pressure. As a result, a desired pressure setpoint within a chamber may be achieved faster, with greater accuracy, and without the need for turning the pump off to allow the pressures to equalize.

Figure 3:
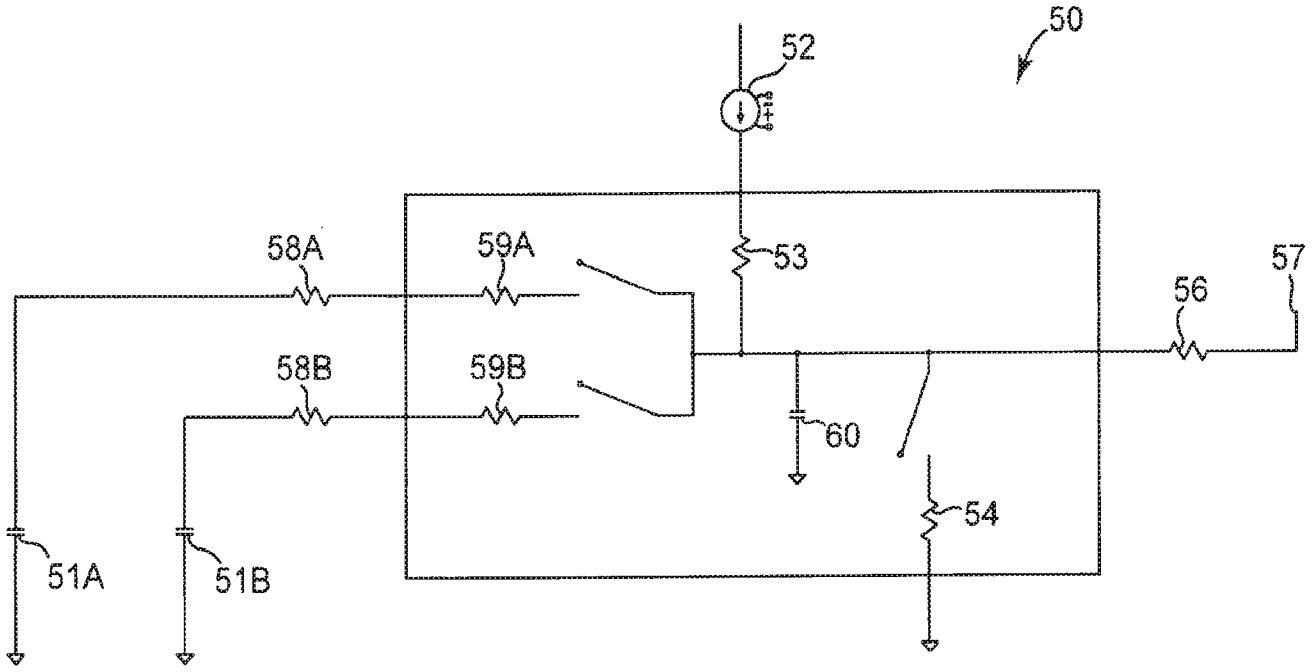
FIG. 3 is a circuit diagram model of the air bed system illustrated in FIGS. 1 and 2.

FIG. 3 is a circuit diagram model 50 of the air bed system 10 illustrated in FIG. 2. As shown in FIG. 3, first and second chambers 14A and 14B may be modeled by capacitors 51A and 51B, motor 42 of pump 20 may be modeled by current source 52 and resistor 53, relief valve 44 may be modeled by resistor 54, pressure transducer 46 may be modeled by resistor 56 and a voltage sensing lead 57, first and second tubes 48A and 48B may be modeled by resistors 58A and 58B, and first and second valves 49A and 49B may be modeled by resistors 59A and 59B. Additionally, pump manifold 43 may be modeled by another capacitor 60 because it also acts as a chamber, albeit much smaller than first and second chambers 14A and 14B.

As those skilled in the art will appreciate, by assuming current source 52 is a constant current source, pressure readings may be analogized with voltage readings. Thus, in reference to the circuit diagram 50 in FIG. 3, the voltages associated with capacitors 51A and 51B may be used to analyze pressure within first and second chambers 14A and 14B, respectively. Because the voltage readings are not dependent upon the capacitance value of capacitors 51A and 51B, the capacitance value may be discarded for purposes of the present analysis. Translated to pressure terms, this means that the size of first and second chambers 14A and 14B is irrelevant when measuring the pressure within the chambers.

Furthermore, weight positioned on a chamber (such as that caused by the user lying on bed 12) is directly related to the volume of the chamber and does not affect the ability of the system to measure the pressure within the chamber. In addition, because the system measures pressure in real time, weight changes do not affect the ability of the control system to accurately measure chamber pressure.

The relationship between the voltage on first or second capacitors 51A or 51B and the voltage sensed at voltage sensing lead 57 is dependent upon whether current is flowing toward the capacitor (i.e., the chamber is going through an inflation cycle) or away from the capacitor (i.e., the chamber is going through a deflation cycle). In particular, and as will be discussed in detail with reference to FIG. 4, modeling air bed system 10 as circuit diagram 50 results in an additive manifold pressure offset factor during an inflation cycle and a multiplicative manifold pressure factor during a deflation cycle.

The relationship between voltage associated with a chamber capacitor (i.e., the "chamber voltage") and the sensed "manifold" voltage during an inflation cycle may be stated as follows:

$$\text{Chamber Voltage}=(\text{Manifold Voltage})-(\text{Inflate Factor}) \quad \text{(Eq. 1)}$$

Restated in terms of pressure, the relationship between the pressure within a chamber and a sensed manifold pressure during an inflation cycle may be stated as follows:

$$\text{Chamber Pressure}=(\text{Manifold Pressure})-(\text{Inflate Factor}) \quad \text{(Eq. 2)}$$

In one exemplary embodiment, the inflate offset factor may generally fall in a range between about 0.0201 and about 0.1601. Because pressure readings may be analogous to voltage readings as discussed previously, the value of the inflate offset factor will be the same regardless of whether the relationship between the chamber and the pump manifold is being stated in terms of pressure or voltage.

The relationship between voltage associated with a chamber capacitor and the sensed manifold voltage during a deflation cycle may be stated as follows:

$$\text{Chamber Voltage}=(\text{Manifold Voltage})\times(\text{Deflate Factor}) \quad \text{(Eq. 3)}$$

Restated in terms of pressure, the relationship between the pressure within a chamber and a sensed manifold pressure during a deflation cycle may be stated as follows:

$$\text{Chamber Pressure}=(\text{Manifold Pressure})\times(\text{Deflate Factor}) \quad \text{(Eq. 4)}$$

In one exemplary embodiment, the deflate factor may generally fall in a range between about 1.6 and about 6.5. Once again, because pressure readings may be analogous to voltage readings as discussed previously, the value of the deflate factor will be the same regardless of whether the relationship between the chamber and the pump manifold is being stated in terms of pressure or voltage.

Figure 4:
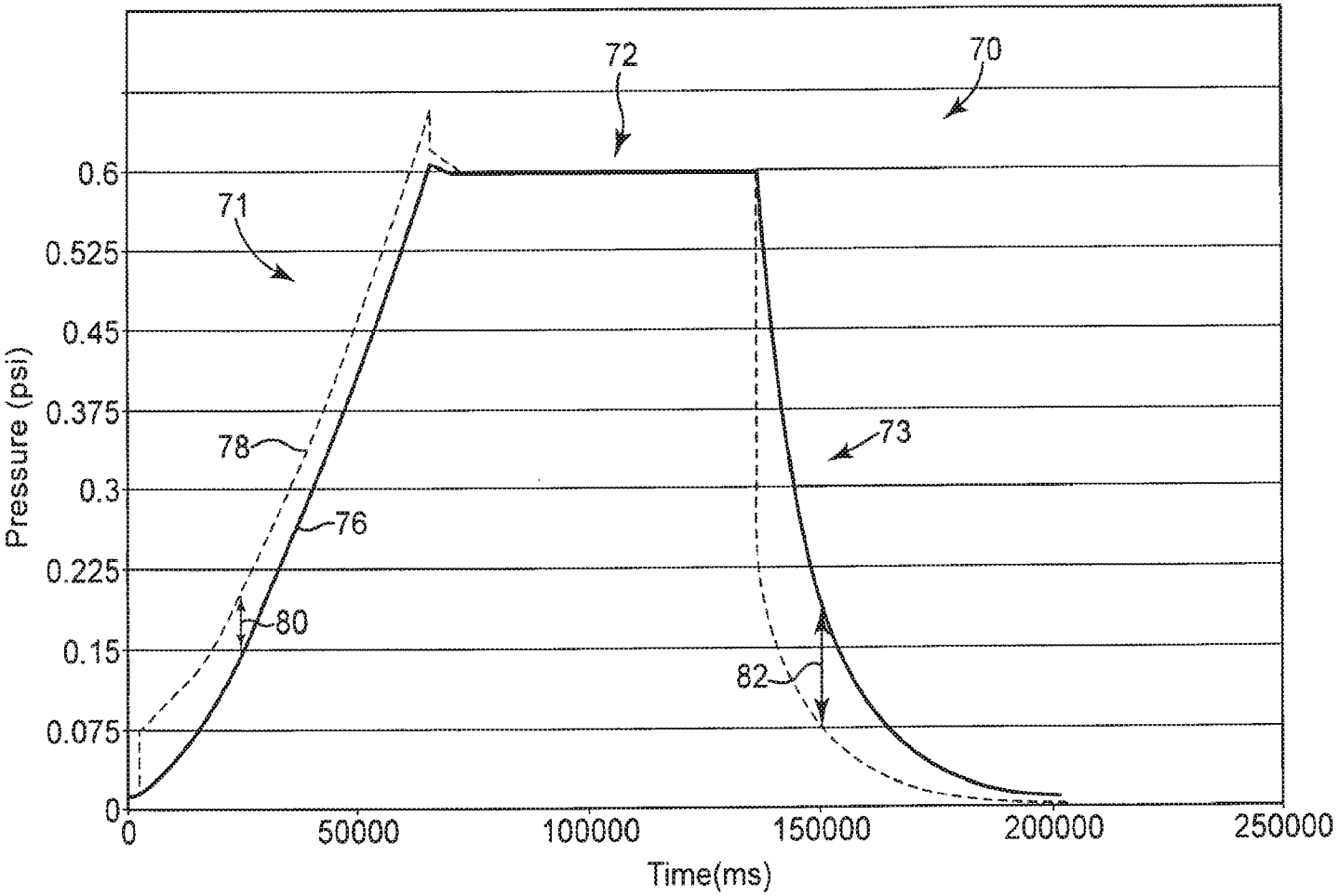
FIG. 4 is an exemplary graph illustrating the pressure relationships derived from the circuit diagram model of FIG. 3.

FIG. 4 is an exemplary graph 70 illustrating the pressure relationships derived from circuit diagram 50 of FIG. 3 and discussed in detail above. In particular, the vertical axis on the graph represents pressure in pounds per square inch (psi), while the horizontal axis on the graph represents time in milliseconds (ms). Thus, the graph illustrates a measure of chamber pressure over time.

In particular, a first portion 71 of the graph 70 between about 0 ms and about 65000 ms represents the inflation of a chamber from about 0 psi to about 0.6 psi. A second portion 72 of the graph 70 between about 65000 ms and about 135000 ms represents the pressure in the chamber being maintained at about 0.6 psi. Finally, a third portion 73 of the graph 70 between about 135000 ms and about 200000 ms represents deflation of the chamber from about 0.6 psi to about 0 psi.

With further reference to the graph in FIG. 4, the solid line 76 represents the actual pressure within the chamber throughout the inflation and deflation cycles, while broken line 78 represents the sensed pump manifold pressure throughout the inflation and deflation cycles. As illustrated in FIG. 4, in the first portion 71 of the graph 70 representing inflation of the chamber, lines 76 and 78 are generally linear and offset from one another by a substantially constant additive offset factor 80. In this exemplary graph, the additive inflate offset factor is about 0.0505. Thus, the pressure within the chamber may be approximated during an inflation cycle by subtracting from the sensed manifold pressure an inflate offset factor of about 0.0505. Lines 76 and 78 generally converge in the second portion 72 of the graph 70 when the chamber is being neither inflated nor deflated. Finally, in the third portion 73 of the graph 74 representing deflation of the chamber, lines 76 and 78 are both non-linear and offset from one another by a substantially constant multiplicative factor 82. In this exemplary graph, the multiplicative deflate factor is about 2.25. Thus, the pressure within the chamber may be approximated during a deflation cycle by multiplying the sensed manifold pressure by a deflate factor of about 2.25.

Now that a brief description of an air bed system and the relationship between chamber and pump manifold pressures have been provided, one embodiment of an improved pressure adjustment method according to the present invention will be described in detail. For purposes of discussion only, the pressure adjustment method in accordance with the present invention will be described in reference to first chamber 14A. However, those skilled in the art will appreciate that the pressure adjustment method applies in a similar manner to other chambers, such as second chamber 14B of bed 12.

In particular, FIG. 5 illustrates a flowchart of a sample control logic sequence of a pressure setpoint monitoring method 100 according to the present invention. The sequence begins at step 102 upon the occurrence of a "power-on" event. A power-on event may be, for example, coupling power supply 34 of control box 24 to an external power source. The sequence continues at step 104 where microprocessor 36 obtains one or more default adjustment constants stored in, for example, memory 37. In one exemplary embodiment, these default adjustments correspond with the additive inflate factor and the multiplicative deflate factor previously described. Thus, for instance, the default additive inflate factor may be about 0.0505, while the default multiplicative deflate factor may be about 2.25. Workers skilled in the art will appreciate that these default values are approximate and were determined for the particular air bed system modeled in FIGS. 1-3 above with an average sized user, and that these values may change as modifications are made to the air bed system. These default adjustment constants will be used by the improved pressure adjustment method of the present invention until they are later updated after a first pressure adjustment iteration as will be discussed in further detail to follow.

The sequence continues at step 106 where microprocessor 36 detects whether a new pressure setpoint has been selected by the user to either increase or decrease the pressure in first chamber 14A. The new pressure setpoint may be a pressure that is either higher or lower than the current pressure in first chamber 14A, as desired by the user. As will be appreciated by those skilled in the art, the range of possible chamber pressures is not important to the operation of the present invention. Thus, numerous pressure ranges are contemplated. The new pressure setpoint may be selected by, for example, manipulating pressure increase button 29 or pressure decrease button 30 on manual remote control 22. Alternatively, the pressure increase and decrease buttons may be provided on another component of system 10, such as pump 20.

If microprocessor 36 does not detect that a new pressure setpoint has been selected, the sequence then continues at step 108 where microprocessor 36 determines whether or not there has been an interfering event, such as a loss in power. If microprocessor 36 determines that a loss in power has occurred, the adjustment factors are then discarded in step 110 and the sequence loops back to step 102 to monitor for the occurrence of another power-on event. However, if microprocessor 36 determines that a loss in power has not occurred, the sequence enters monitoring loop 112 where microprocessor 36 continually monitors whether a new pressure setpoint is selected in step 106 or whether a loss in power has occurred in step 108.

Alternatively, if microprocessor 36 detects that a new pressure setpoint has been selected in step 106, then the sequence continues to pressure adjustment method 150 as will be described in detail in reference to FIG. 6. Thus, the selection of a new pressure setpoint by the user triggers a pressure adjustment.

As will be appreciated by those skilled in the art, air bed system may include a back-up power source such that if the power to power supply 34 is interrupted, the pressure adjustment factors remain stored within memory 37. As a result, it may be possible to avoid the discarding step previously described.

FIG. 6 illustrates a flowchart of a sample control logic sequence of an exemplary pressure adjustment method 150 according to the present invention. The sequence begins at step 152 when pressure transducer 46 samples the pressure within pump manifold 43. Because motor 42 of pump 20 is not running at this point, air is neither flowing into or out of first chamber 14A. Therefore, the manifold pressure sampled in step 152 is substantially stable and a fairly accurate approximation of the actual pressure within first chamber 14A. After the manifold pressure has been sampled in step 152, the method continues at step 154 where microprocessor 36 compares the sampled manifold pressure to the desired pressure previously selected by the user (in step 106) to determine if an adjustment is required. In one embodiment, microprocessor 36 calculates the difference between the sampled manifold pressure and the desired pressure setpoint selected by the user, and compares the difference to a predetermined, acceptable "error." The acceptable error may be any value greater than or equal to zero. If the absolute value of the difference between the sampled manifold pressure and the desired pressure setpoint selected by the user is less than or equal to the acceptable error, then no adjustment is required, and the pressure adjustment method ends at step 156 where microprocessor 36 determines that the pressure adjustment process is complete. However, if the difference between the sampled manifold pressure and the desired pressure setpoint selected by the user is not within the acceptable error range, then an adjustment is required, and the pressure adjustment method continues at step 158.

In step 158, microprocessor 36 determines if inflation or deflation of first chamber 14A is required. If it is determined in step 158 that deflation of first chamber 14A is required, the method continues at step 160 where microprocessor 36 calculates a deflate pressure target, which corresponds to the sensed manifold pressure that will yield the desired pressure setpoint during a deflation cycle. In particular, the deflate pressure target may be calculated through use of Equation 4 above. Based upon the relationship between chamber pressure and manifold pressure during a deflation cycle recited in Equation 4, the deflate pressure target may calculate as follows:

$$\text{Deflate Manifold Pressure Target} = (\text{Desired Pressure Setpoint})/(\text{Deflate Factor})$$

The first time the user selects a new pressure setpoint that requires deflation of first chamber 14A, the deflate factor will be set to the default value of 2.25 discussed above in step 104. However, as will be discussed in further detail to follow, this deflate factor will be modified at a later step in order to more accurately reflect the mathematical relationship between the chamber pressure and the sensed manifold pressure for that particular user.

Once the deflate pressure target is calculated in step 160, microprocessor 36 instructs pump 20 to begin the deflate operation in step 162.

Alternatively, if it is determined in step 158 that inflation of first chamber 14A is required, the method continues at step 164 where microprocessor 36 calculates an inflate pressure target. The inflate pressure target corresponds to the sensed manifold pressure that will yield the desired pressure setpoint during an inflation cycle. In particular, the inflate pressure target may be calculated through use of Equation 2 above. Based upon the relationship between chamber pressure and manifold pressure during an inflation cycle recited in Equation 2, the inflate pressure target may calculate as follows:

Inflate Manifold Pressure Target=(Desired Pressure Setpoint)+(Inflate Offset Factor)

The first time the user selects a new pressure setpoint that requires inflation of first chamber 14A, the inflate factor will be set to the default value of 0.0505 discussed above in step 104. However, as will be discussed in further detail to follow, this inflate factor will be modified at a later step in order to more accurately reflect the mathematical relationship between the chamber pressure and the sensed manifold pressure for that particular user.

Once the inflate pressure target is calculated in step 164, microprocessor 36 instructs pump 20 to begin the inflate operation in step 166.

After performing the pressure deflate operation in step 162 or the pressure inflate operation in step 166 as required, the manifold pressure within pump manifold 43 is once again sampled in step 168. Because either motor 42 of pump 20 has been running in order to inflate first chamber 14A, or relief valve 44 has been open in order to deflate first chamber 14A, the manifold pressure sampled in step 168 is now instable and by itself does not provide an accurate representation of the actual pressure within first chamber 14A. However, because of the known relationship between manifold pressure and chamber pressure discussed previously, the present invention is able to accurately approximate the actual chamber pressure based upon a sensed manifold pressure. Therefore, after the manifold pressure has once again been sampled, the method continues at step 170 where microprocessor 36 compares the sampled manifold pressure to the manifold pressure target calculated in either step 160 or step 164 to determine if the manifold pressure target has been achieved.

Similar to the process utilized in step 154, microprocessor 36 calculates the difference between the sampled manifold pressure and the manifold pressure target and compares the difference to a predetermined, pressure target error. The pressure target error may be any value greater than or equal to zero. If the absolute value of the difference between the sampled manifold pressure and the manifold pressure target is greater than the acceptable pressure target error, then further inflation or deflation is required. As a result, pressure adjustment method 150 returns along path 172 to either deflate operation 162 or inflate operation 166, depending upon whether the manifold pressure sampled in step 168 was less than or greater than the manifold pressure target. On the other hand, if the difference between the sampled manifold pressure and the manifold pressure target is within the pressure target error limit, then no further inflation or deflation is necessary, and the pressure adjustment method continues at step 174 where the inflate or deflate operation is ended.

Next, pressure transducer 46 once again samples the pressure within pump manifold 43 at step 176. Because all inflate or deflate operations have ceased, air is neither flowing into nor out of first chamber 14A, and the manifold pressure sampled in step 176 is substantially stable and a fairly accurate approximation of the actual pressure within first chamber 14A. After the manifold pressure has been sampled again in step 176, the sequence continues at step 178 where microprocessor 36 compares the "actual" manifold pressure sampled in step 176 with the "expected" user setpoint pressure previously selected by the user (in step 106) to determine if the desired setpoint pressure has been achieved. If the actual manifold pressure sampled in step 176 is not substantially equal to the expected setpoint pressure selected by the user, then an adjustment must be made to the pressure adjustment factor. An updated adjustment factor is therefore determined based upon a comparison between the sensed pressure and the desired setpoint pressure, and the pressure adjustment factor is thereafter modified in step 180.

With regard to the deflate pressure adjustment factor, an updated factor may be calculated in the following manner:

Updated Deflate Adjustment Factor=(Pressure Setpoint from Step 106)/(Manifold Pressure from Step 168)

With regard to the inflate pressure adjustment factor, an updated factor may be calculated in the following manner:

Updated inflate Adjustment Factor=(Manifold Pressure from Step 168)−(Pressure Setpoint from Step 106)

Next, the method loops back to step 152 where pressure transducer 46 samples the pressure within pump manifold 43. Once the manifold pressure has again been sampled in step 152 after a first "iteration" of adjustments, the method continues at step 154 where microprocessor 36 compares the sampled manifold pressure to the desired pressure selected by the user (in step 106) to determine if a further adjustment is required. For instance, if the pressure adjustment factor had to be modified in step 180 of the previous pressure adjustment iteration, then a further adjustment will most likely be required because the fact that the pressure adjustment factor had to be modified indicates that the actual pressure in chamber 14A is not equal to the desired pressure setpoint selected by the user. In this case, at least one more pressure adjustment iteration will be required before the actual chamber pressure is substantially equal to the desired pressure setpoint. However, if it is determined in step 154 that the absolute value of the difference between the sampled manifold pressure and the desired pressure setpoint is less than or equal to the acceptable error, then no adjustment is required, and the pressure adjustment method ends at step 156 where microprocessor 36 determines that the pressure adjustment process is complete.

After completing the pressure adjustment method 150, microprocessor 36 return back to pressure setpoint monitoring method 100 illustrated in FIG. 5 and replaces the default deflate or inflate pressure adjustment factor in step 114 with a "customized" pressure adjustment factor specifically tailored to that user. The customized pressure adjustment factor may then be stored in memory 37 for future use in pressure adjustments.

As those skilled in the art will appreciate, the default pressure adjustment factors corresponding to both the deflate and inflate operations must be replaced after the detection of a power-on event because these default factors are only temporary and based upon the size of an average user. Therefore, when microprocessor 36 detects an increase in the desired pressure setpoint for the first time at step 106, then execution of pressure adjustment method 150 will result in a customized inflate pressure adjustment constant being determined that replaces the temporary default constant. Similarly, when microprocessor 36 detects a decrease in the desired pressure setpoint for the first time at step 106, then execution of pressure adjustment method 150 will result in a customized default pressure adjustment constant being determined that replaces the temporary default constant. Furthermore, when microprocessor 36 detects subsequent increases or decreases in the desired pressure setpoint after the default constants have been replaced, the customized default constants may continue to be updated and replaced in step 114 to maintain the highest degree of accuracy when performing pressure adjustments and to take into account changes in the user such as, for example, an increase or decrease in the weight of the user. Thus, while it is not necessary to "update" the customized adjustment constants after initially replacing the temporary default adjustment constants after a power-on event, performing such updates may increase the accuracy of future pressure adjustments.

FIG. 7 illustrates a flowchart of a sample control logic sequence of a second pressure adjustment method 150A according of the present invention. Pressure adjustment method 150A is similar to pressure adjustment method 150 previously described, but includes several additional steps to further optimize operation of the pressure adjustment method.

In addition to the steps previously described above in reference to FIG. 6, pressure adjustment method 150A further includes steps 151, 182, and 173. In particular, steps 151 and 182 involve maintaining a count of the number of pressure adjustment attempts remaining during a pressure adjustment operation, while step 173 involves tracking elapsed time during an inflation or deflation cycle.

With regard to steps 151 and 182, the number of pressure adjustment "attempts" may be tracked to limit the number of pressure adjustment iterations that pressure adjustment method 150A may perform after a new pressure setpoint has been selected. In particular, prior to sensing manifold pressure in step 152, microprocessor 36 determines if the number of remaining attempts is greater than zero. If the number of attempts remaining is greater than zero, then the method continues at step 154 where microprocessor 36 determines if a pressure adjustment is required. However, if the number of attempts remaining is not greater than zero, then the method instead continues at step 156 where the pressure adjustment is presumed to be complete. Thus, pressure adjustment method 150A may allow for a predetermined number of iterations before the pressure adjustment method "times out." In one exemplary embodiment, the default number of attempts may be set to four. However, any number of attempts are possible and within the intended scope of the present invention.

If the pressure adjustment factor (either inflate or deflate) is modified in step 180, then the number of remaining attempts is decremented by one attempt in step 182. Therefore, if the desired pressure setpoint is not reached within four attempts, no further pressure adjustment is attempted and the pressure adjustment factor corresponding to the final iteration will be used to update the temporary default adjustment constant as previously discussed.

With regard to step 173, the amount of time elapsed during a pressure adjustment operation may also be also be tracked. As discussed above, if it is determined in step 170 that the pressure target has not been achieved, pressure adjustment method 150A returns along path 172 to either deflate operation 162 or inflate operation 166, depending upon whether the manifold pressure sampled in step 168 was less than or greater than the manifold pressure target. However, prior to reaching either deflate operation step 162 or inflate operation step 166, the method first enters step 173 where microprocessor 36 monitors the time that has elapsed since the initial determination was made in step 170 regarding whether or not the manifold pressure target has been achieved. Thus, if the amount of elapsed time is less than a maximum, predetermined time period, the sequence continues within loop 172 to inflate or deflate first chamber 14A as necessary in an attempt to achieve the manifold pressure target. However, if the desired pressure target has not been reached when microprocessor 36 determines that the maximum time period has expired, then the method exits loop 172 and advances directly to step 156, where no further adjustment will be attempted.

The maximum, predetermined time period may be any value greater than zero. However, in one exemplary embodiment of pressure adjustment method 150A, the maximum time period may be about 30 minutes. Generally speaking, the maximum time period may be selected such that the manifold pressure target is not achieved prior to the expiration of the maximum time period only if air bed system 10 is not functioning properly. For example, if first tube 48A becomes disconnected from first chamber 14A, it will most likely not be possible to attain the manifold pressure target in step 170. Under these circumstances, and without the addition of the time tracking step 173, pump 20 may continue to run until the user disconnects power from the pump or notices that first tube 48A has been disconnected from first chamber 14A.

Workers skilled in the art will appreciate that although the features added in steps 151, 173, and 182 are not necessary components of the present invention, their presence helps to optimize the operation of the pressure adjustment method by preventing the method from being trapped in a "continuous loop" of attempting to reach the desired pressure setpoint. Furthermore, it will be obvious to those skilled in the art that the order and number of steps described in reference to FIGS. 5-7 may be modified without departing from the intended scope of the present invention.

Figure 8:
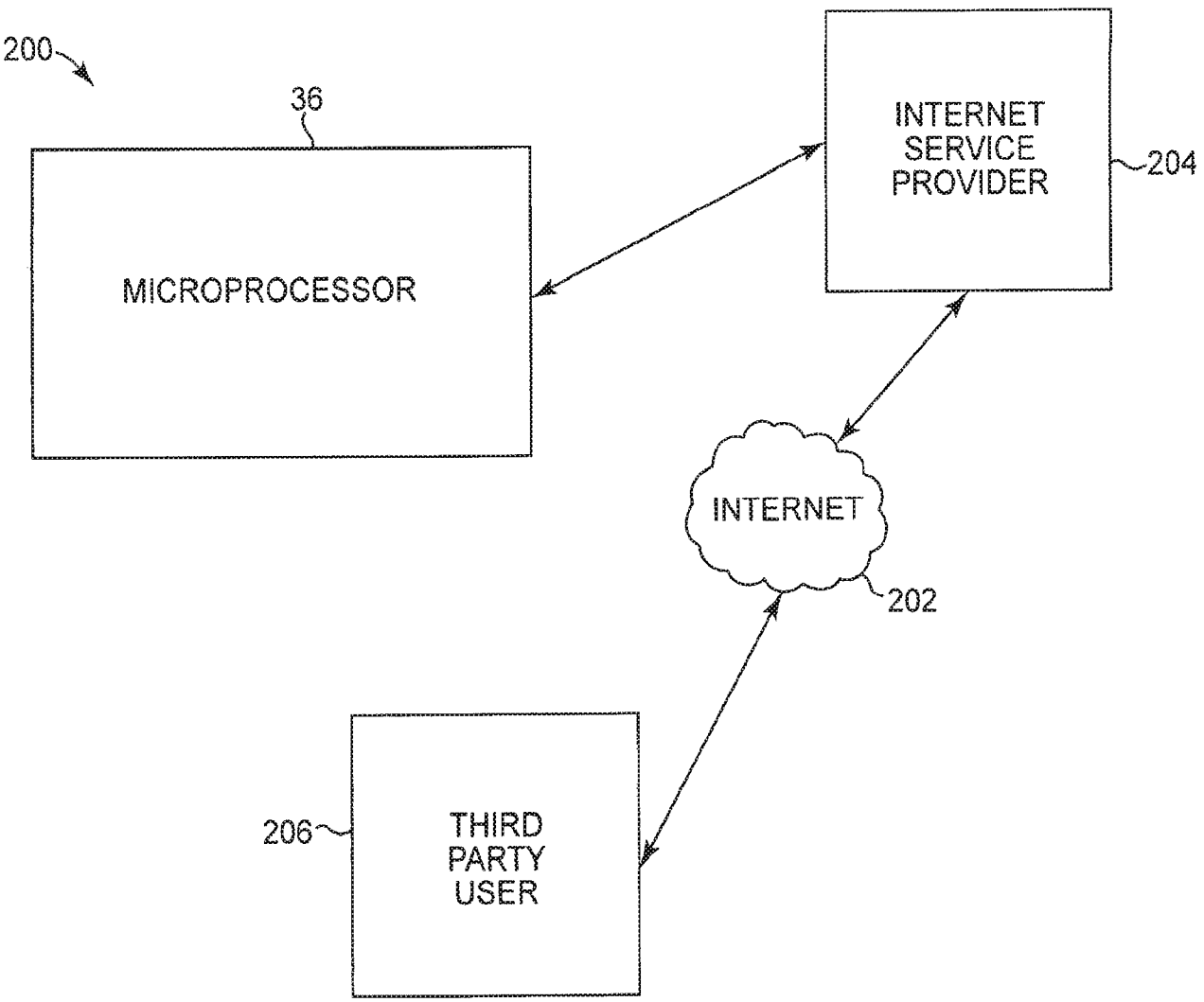
FIG. 8 is a block diagram illustrating an air bed system according to the present invention incorporated into a network system for remote access.

Referring now to FIG. 8, in yet another alternate embodiment in accordance with the present invention, microprocessor 36 may be integrated within network 200 for remote accessing and use of a pressure adjustment method according to the present invention for improving the accuracy and minimizing the time of pressure adjustments. This allows for centralized data storage and archival of air bed system information (such as customized pressure adjustment factors) by, for example, the customer service department of the air bed system manufacturer. Additionally, networking may provide for information input and retrieval, as well as remote access of control box 24 to operate the air bed system.

Network 200 may be integrated either locally or accessible via a public network protocol such as the Internet 202 and optionally through an Internet service provider 204. Connection to network 200 may be wired or wireless, and may incorporate control from a detached device (e.g., handheld, laptop, tablet, or other mobile device). In addition, microprocessor 36 may be accessible remotely by a third party user 206 via Internet 202 and/or Internet service provider 204.

Network 200 may be configured to enable remote pressure adjustment of an air bed system by a third party user 206, such as by a customer service representative at a remote location. In particular, the customer service representative may be able to remotely connect to Internet 202 and assist the user in performing a pressure adjustment set-up, such as pressure adjustment method 150 previously described, in order to optimize the accuracy and operation of the pressure adjustment method. Network 200 may also be configured to allow the customer service representative to access and store the customized pressure adjustment factors in, for example, a central storage system in case of a power loss or similar event. Numerous other advantages of network 200 will be appreciated by those having ordinary skill in the art.

Although the present invention has been described with reference to preferred embodiments, workers skilled in the art will recognize that changes may be made in form and detail without departing from the spirit and scope of the invention.

We claim:

1. A valve enclosure assembly comprising:

an enclosure defining a substantially fluidly sealed air chamber and having at least one air inlet to the air chamber configured to be fluidly coupled to a pump;

a port fluidly coupled to an interior of the enclosure that is designed to receive a tube;

a pressure sensor;

a tube connected to the port and the pressure sensor;

at least one valve operably coupled to the enclosure being in selective fluid communication with the air chamber of the enclosure; and a controller comprising at least one microprocessor and memory, wherein the controller is in communication with the pressure sensor, the at least one valve and a pump to control the at least one valve and the pump, wherein the controller is configured to:

select a desired pressure setpoint, wherein the desired pressure setpoint is a value that corresponds to a desired pressure;

calculate an enclosure pressure target, wherein the enclosure pressure target is calculated based upon the desired pressure setpoint and a pressure adjustment factor, wherein the enclosure pressure target is calculated to approximate the desired pressure setpoint as modified by the pressure adjustment factor to account for differences between sensing pressure in the enclosure and sensing pressure in an object to be inflated;

sense pressure within the enclosure;

adjust pressure until the sensed enclosure pressure is inside of acceptable bounds of an acceptable pressure target error range of the enclosure pressure target;

determine an actual pressure within the object to be inflated;

compare the actual pressure of the object to be inflated to the desired pressure setpoint for the object to be inflated to determine an adjustment factor error;

modify the pressure adjustment factor based upon the adjustment factor error to create a modified pressure adjustment factor configured to more accurately account for differences between sensing pressure in the enclosure and sensing pressure in the object to be inflated; and store the modified pressure adjustment factor in memory;

calculate a modified enclosure pressure target, wherein the modified enclosure pressure target is calculated based upon the desired pressure setpoint for the object to be inflated and the modified pressure adjustment factor; and adjust pressure within the object to be inflated until pressure sensed within the enclosure is substantially equal to the modified enclosure pressure target.

2. The valve enclosure assembly of claim 1, wherein the object to be inflated is a mattress air chamber.

3. A bed system comprising:

a mattress having a mattress air chamber;

a pump system comprising:

a pump; and the valve enclosure assembly of claim 1.

4. A pump system comprising:

a pump; and the valve enclosure assembly of claim 1, wherein the valve enclosure assembly is fluidly connected to the pump and is configured to be fluidly connected to a mattress air chamber.

5. The valve enclosure assembly of claim 1, wherein the desired pressure setpoint is between about 0 psi (pounds per square inch) to about 0.6 psi.

6. The valve enclosure assembly of claim 1, wherein, if the enclosure pressure target is an inflation pressure target, then the pressure adjustment factor is an additive pressure adjustment factor.

7. The valve enclosure assembly of claim 1, wherein, if the enclosure pressure target is an inflation pressure target, then the pressure adjustment factor is an additive pressure adjustment factor and wherein, if the enclosure pressure target is a deflation pressure target, then the pressure adjustment factor is a multiplicative pressure adjustment factor.

8. The valve enclosure assembly of claim 1, wherein the enclosure comprises structure to position solenoids within the valve enclosure assembly.

9. The valve enclosure assembly of claim 1, wherein the pressure sensor is configured to continuously monitor pressure.

10. The valve enclosure assembly of claim 1, wherein the controller is in data communication with a mobile device via an internet connection.

11. A valve enclosure assembly comprising:

an enclosure defining a substantially fluidly sealed air chamber and having at least one air inlet to the air chamber configured to be fluidly coupled to a pump;

at least one valve operably coupled to the enclosure being in selective fluid communication with the air chamber of the enclosure and configured to be in fluid communication with at least one air bladder for selectively fluidly coupling the air chamber of the enclosure to the at least one air bladder;

a port fluidly coupled to an interior of the air chamber of the enclosure that is designed to receive a tube;

a pressure sensor;

a tube connected to the port and to the pressure sensor, the pressure sensor being operably coupled to a processor and being in fluid communication with the at least one valve for monitoring the pressure in the at least one air bladder; and a controller comprising at least the processor and memory, wherein the controller is in communication with the pump and the at least one valve to control the pump and valve and is configured to:

receive a selection for a first desired pressure setpoint for a first air bladder, wherein the first desired pressure setpoint represents a desired pressure between about 0 psi (pounds per square inch) to about 0.6 psi;

receive a selection for a second desired pressure setpoint for a second air bladder, wherein the second desired pressure setpoint represents a desired pressure between about 0 psi to about 0.6 psi;

calculate a first pressure target for the enclosure, wherein the first pressure target for the enclosure is calculated based upon the first desired pressure setpoint for the first air bladder and a first pressure adjustment factor, wherein, if the first pressure target is a first inflate pressure target, then the first pressure adjustment factor is a first additive pressure adjustment factor, and calculate a second pressure target for the enclosure, wherein the second pressure target for the enclosure is calculated based upon the second desired pressure setpoint for the second air bladder and a second pressure adjustment factor, wherein, if the second pressure target is a second inflate pressure target, then the second pressure adjustment factor is a second additive pressure adjustment factor, and adjust pressure within the first air bladder until a pressure sensed within the enclosure is substantially equal to the first pressure target, wherein the pressure of the enclosure is sensed via the pressure sensor that is fluidly connected to the enclosure at the port via the tube;

adjust pressure within the second air bladder until a pressure sensed within the enclosure is substantially equal to the second pressure target, wherein the pressure of the enclosure is sensed via the pressure sensor that is fluidly connected to the enclosure at the port via the tube;

determine a first actual bladder pressure within the first air bladder;

determine a second actual bladder pressure within the second air bladder;

compare the first actual bladder pressure to the first desired pressure setpoint to determine a first adjustment factor error;

compare the second actual bladder pressure to the second desired pressure setpoint to determine a second adjustment factor error;

modify the first pressure adjustment factor based upon the first adjustment factor error; and modify the second pressure adjustment factor based upon the second adjustment factor error.

12. A bed system comprising:

a pump system comprising:

the valve enclosure assembly of claim 11; and the pump; and an air mattress comprising the first and second air bladders.

13. The bed system of claim 12, and further comprising:

means for centralized data storage and archival of air bed system information.

14. The valve enclosure assembly of claim 11, wherein, if the first pressure target is a first deflation pressure target, then the first pressure adjustment factor is a first multiplicative pressure adjustment factor and wherein, if the second pressure target is a second deflation pressure target, then the second pressure adjustment factor is a second multiplicative pressure adjustment factor.

15. The valve enclosure assembly of claim 11, wherein the valve enclosure assembly comprises structure to position solenoids within the valve enclosure assembly.

* * * * *